US005743727A

United States Patent [19]

Rodgers

[11] Patent Number: 5,743,727

[45] Date of Patent: Apr. 28, 1998

[54] PREMIXED GAS BURNER

[75] Inventor: Ian M. Rodgers, Ooltewah, Tenn.

[73] Assignee: Burner Systems International, Inc., Chattanooga, Tenn.

[21] Appl. No.: 786,032

[22] Filed: Jan. 21, 1997

[51] Int. Cl.[6] ..... F23D 14/12

[52] U.S. Cl. ..... 431/328; 431/354; 239/553.3

[58] Field of Search ..... 431/328, 329, 431/354; 239/553.3

[56] References Cited

U.S. PATENT DOCUMENTS

| | | | |
|---|---|---|---|
| 3,156,292 | 11/1964 | Ross | 239/553.3 |
| 3,907,210 | 9/1975 | Dow et al. | 239/553.3 |
| 4,140,100 | 2/1979 | Ishihara | 431/328 |
| 5,240,411 | 8/1993 | Abalos | 431/329 |

*Primary Examiner*—Carroll B. Dority

*Attorney, Agent, or Firm*—Alan Ruderman

[57] ABSTRACT

A premixed gas burner has an elongated hollow burner body including a burner deck formed by a multiplicity of burner ports about a small sector of the body. The burner body is closed at one end and an elongated distribution tube is received within the body through and extending out the other end. The end of the distribution tube extending out of the burner body has an inlet into which a mixture of gas and air may enter, the opposite end of the distribution tube being closed. A series of directional ports formed between louvered slats adjacent the closed end and spaced from the inlet are formed along a small sector of the distribution tube and directs the mixture of gas and air back toward the inlet end. The sector of the distribution tube in which the ports are formed is substantially 180° from the sector of the burner body in which the deck ports are formed. The construction provides good mixing, and substantially prevents flashback by having high velocity throughout the burner, and good distribution without a high pressure drop.

20 Claims, 1 Drawing Sheet

PREMIXED GAS BURNER

BACKGROUND OF THE INVENTION

This invention relates to a premixed gas combustion burner, and more particularly to a burner of this type including a hollow burner with a deck having a multiplicity of burner flame ports along a sector of its periphery, the burner being open at one end and closed at the opposite end, and a gas/air distribution tube within the deck sealed at the closed end of the deck which provides good mixing, a high velocity mixture and an even distribution of the mixture throughout the burner deck.

Premixed gas burners used in boilers and other large heaters provide a high heat release in a small area while providing low pollutant gas combustion emissions. Generally such premixed gas burners comprise a hollow body distribution tube having a closed end and an open end into which the premixed gas flows. The burner body includes at least a portion which has a multiplicity of holes through and out which the gas and air mixture from the interior of the body flows. Another member which has the burner flame port perforations, through and out which the gas and air mixture from the interior of the body flows, and which in the case of cylindrical burners such as those disclosed in U.S. Pat. No. 4,657,506 and Canadian Patent No. 1,303,958, may be a coaxial shell, or in certain designs such as in U.S. Pat. No. 5,520,536 may be a substantially planar member, known as a deck is spaced outwardly or downwardly from the distribution tube or body of the burner.

Premixed gas combustion flames are short with the flame front just beyond or above the burner port or deck surface. Normally, the mixture has approximately 30 percent excess air so as to provide cleaner combustion products. At loadings, i.e., heat per unit area which are relatively low, the burner port surface will be radiant since the velocity of the mixture is low resulting in the flame being positioned on or closely adjacent to the surface. This gives rise to problems of thermal fatigue and high temperature oxidation of the burner port surface or deck, and potential flashback of the flame into the burner body. At higher loadings, the increase in volumetric flow is such that the velocity of the mixture may be increased to the point where the flame from is further from the burner port surface resulting in a blue flame and the surface of the burner ports material is relatively cool. However, even at higher loadings, if the amount of excess air is not or cannot be controlled resulting in inadequate excess air, burner surface overheating may result.

In certain of the prior art premixed burners, distribution devices are used to spread the mixture over the burner surface. These devices cause local disturbances in the distribution which causes the velocity of the mixture exiting from the burner deck to be reduced. This reduction in exit velocity may lead to flashback or instability in the flame. Unstable flames additionally may result in flashback and/or flame lift, which leads to the production of carbon monoxide and are usually accompanied by noise.

It is therefore important to construct a premixed gas burner wherein the velocity of the mixture exiting from the burner deck is relatively high so that the flame front is not closely adjacent the surface of the deck thereby to provide a blue flame rather than a radiant burner deck surface. Moreover, a high velocity gas air mixture throughout the entire burner system inhibits flashback of the mixture. The prior art burners accomplish this in various degrees, but those which are efficient are relatively expensive to construct and manufacture.

SUMMARY OF THE INVENTION

Consequently, it is a primary object of the present invention to provide a premixed gas combustion burner having a distribution tube within a burner deck, the distribution tube acting to provide a high velocity gas air mixture throughout the entire burner so as to reduce flashback even at relatively low excess air levels.

It is another object of the present invention to provide an inexpensive premixed gas burner having a burner deck having outlet ports disposed along a sector of the deck and positioned about an elongated distribution tube into one end of which the gas and air flow and which is closed at the opposite end, the distribution tube having directional porting to direct the mixture away from the closed end and toward the inlet end and being disposed adjacent the closed end and about only a portion of the periphery of the tube, that portion being a sector of the tube which is disposed oppositely to the outlet ports in the burner deck thereby to provide a large mixing length within the burner body while maintaining a high velocity within the entire length of the burner.

It is a further object of the present invention to provide a premixed gas combustion burner including a hollow burner having a closed end and including a deck having a multiplicity of burner flame ports along a sector of its periphery, and an elongated gas/air distribution tube within the burner having an inlet end and a closed end and being sealed at the closed end and having ports adjacent the sealed end which direct the mixture away from the closed end, the distribution tube ports facing oppositely to the burner deck ports, the construction providing good mixing, a high velocity mixture and an even distribution of the mixture throughout the burner.

Accordingly, the present invention provides an inexpensive premixed gas burner comprising an elongated hollow burner body having a burner deck including a multiplicity of burner ports disposed to a surface thereof longitudinally about a sector of the body and closed at one end, and an elongated distribution tube received within the burner body through and extending out the other end. The distribution tube has a gas/air mixture injected into an inlet end and is closed at the opposite end, and has a plurality of ports adjacent the closed end and spaced from the inlet end, the distribution ports being formed along a sector thereof which faces in a direction oppositely to the ports of the deck and is constructed to direct the gas/air mixture back toward the inlet end.

The construction of the distribution tube is such that it provides a large mixing length within the burner and maintains a high velocity within the entire burner system since it displaces a volume of the burner body equal to its own volume and distributes the mixture evenly at substantially equal velocity to the flame ports in the deck and thereby the loading on the deck is high and substantially constant. By keeping the velocity of the mixture high throughout the burner, flashback is prevented.

In the preferred embodiment of the invention, the burner body and the body of the distribution tube are substantially cylindrical and the closed end of the distribution tube is closed against the burner body closure, and the ports are formed by louvers upset from and into the body of the distribution tube.

BRIEF DESCRIPTION OF THE DRAWINGS

The particular features and advantages of the invention as well as other objects will become apparent from the following description taken in connection with the accompanying drawings.

DESCRIPTION OF THE PREFERRED EMBODIMENT

Figure 1:
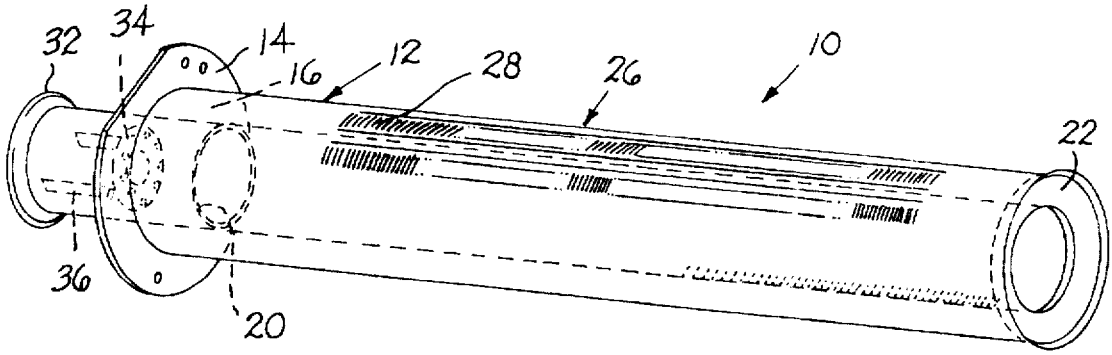
FIG. 1 is a perspective view of a gas burner constructed in accordance with the present invention.
Figure 2:
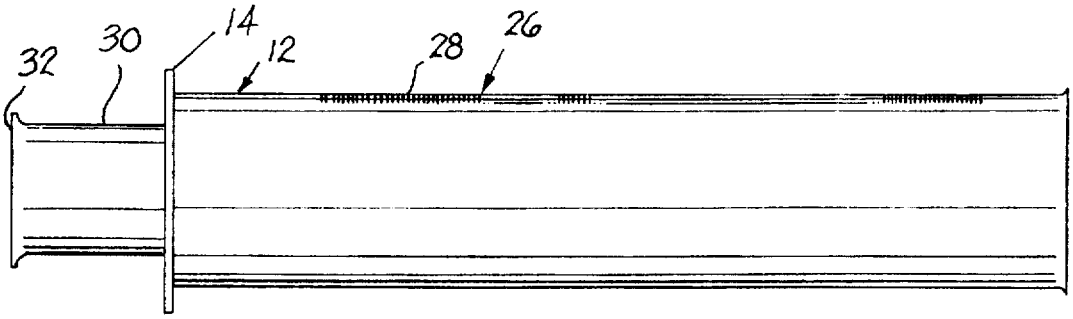
FIG. 2 is a side elevational view thereof.

Referring to the drawings, a premixed gas burner 10 constructed in accordance with the principles of the present invention comprises a hollow burner body 12 which preferably is formed from stainless steel and has a curvilinear cross sectional configuration, preferably circular, as illustrated, but which may be oval without departing from the principles of the present invention. Thus, in accordance with the preferred embodiment the burner body 12 has a cylindrical configuration. A flange 14 is secured to the inlet end of the burner body by welding or the like, the flange having an integral annular hub 16 which is securely received in abutment with the interior wall 18 of the body 12 and includes a central opening 20 concentric with the periphery of the body and thus is circular in cross sectional configuration. It will be understood by those skilled in the art that the flange 14 is adapted to be fastened to the appliance (not illustrated) within which the burner is utilized such as a boiler, pool heater, water heater or the like. The end of the burner body 12 opposite the flange 14 is closed by a closure member or end cap 22 attached to the body by welding or the like, the closure member preferably having a boss 24, best illustrated in FIG. 3, extending into the body and being of a configuration substantially concentric with the body 12 and of a diameter slightly smaller than that of the opening 20 and aligned therewith.

Formed through the burner body intermediate its ends and which may but not necessarily be spaced equally from the ends is the burner deck 26 which is highly perforated with the burner ports 28. Preferably, the deck, i.e., the multiplicity of ports 28, extends in an arc or sector of the surface of the body 12 which is but a small portion of the entire circumference. For example, in a prototype burner having a two inch diameter, the deck comprises an arc of approximately one inch of the surface, that is a sector of approximately 60° of the circumference. The pattern of the ports 28 are not critical and may include circular openings and elongated slots as illustrated in the aforesaid U.S. Pat. No. 5,520,536, or may be of any other configuration, many of which are known in the prior art.

Figure 3:
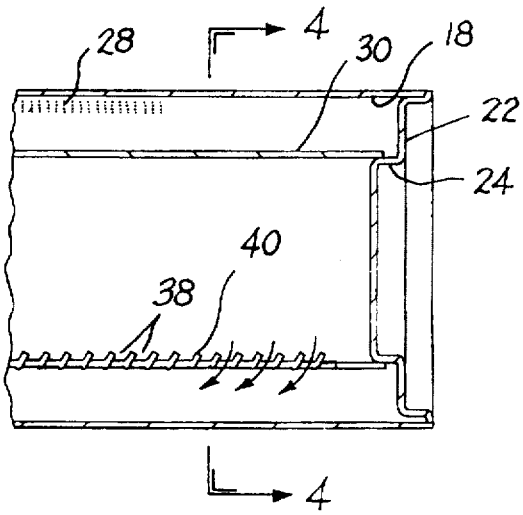
FIG. 3 is a fragmentary longitudinal cross sectional view taken through the burner of FIG. 1 at the closed end.
Figure 4:
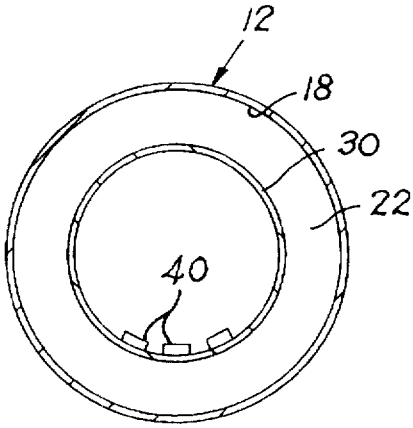
FIG. 4 is a cross sectional view taken substantially through line 4—4 of FIG. 3.

Extending through the opening 20 of the flange 14 and disposed within the burner body 12 is a hollow distribution tube 30, preferably formed from aluminized mild steel or may be formed from stainless steel, which is of substantially the same cross sectional configuration as the burner body and thus is a hollow cylinder in the preferred embodiment. The exterior diameter of the distribution tube 30 is very slightly smaller than the opening 20 and the interior diameter is very slightly larger than the diameter of the boss 24. The boss 24 is snugly received within the interior of the distribution tube 30, as illustrated in FIG. 3, and acts to close the end of the tube 30 at the closed end of the burner body such that the closure member 22 closes both the burner body 12 and the distribution tube 30. The distribution tube is thus held securely within the burner body 12 by the flange 14 and the closure member 22. Of course, rather than this construction, separate closure members may be utilized in which case the closure of the distribution tube will occur before the tube is inserted into the body 12. The distribution tube 30 is preferably longer than the burner body and the end 32 of the distribution tube remote from the closure 22 projects out beyond the flange 14. A gas/air mixture enters the end 32 of the tube 30, which is thus the inlet end of the tube, and may be directed through a mixing device 34 having a central opening and a series of apertures about the opening, the mixing head 34 being formed integral with attachment legs 36 spot welded to the interior of the tube 30 just inside the inlet end 32. Thus, a flammable mixture of gas and air may be injected into the distribution tube 30.

In accordance with the present invention the distribution tube 30 includes a longitudinal series of ports 38 formed therethrough, the ports extending from adjacent the closed end to a location intermediate the ends of the tube. Although one row of ports 38 may be utilized, in the preferred embodiment there are three rows which are disposed along an arc of approximately 60° of the surface of the tube 30. The ports 38 are formed by upsetting material from the surface of the tube into the tube to form slanting overlapping slats defining louvers 40 extending rearwardly from the surface at an angle such that the mixture within the distribution tube may be directed to flow toward the inlet end of the tube between the tube 30 and the burner body 12. Additionally, and significantly, the louvers 40 and thus the distribution tube ports 48 are disposed oppositely to the burner ports 28, i.e., the ports 38 are disposed substantially 180° from the ports 28, or stated another way, the arc or sector of the surface of the ports 38 in the distribution tube is disposed remotely or oppositely from the arc or sector of the surface of the ports 28 in the deck 26.

With the aforesaid construction, the velocity of the mixture throughout the burner tube is high and an even distribution of the mixture is obtained throughout the burner. The mixture is not permitted to slow down significantly from exiting the tube 30 in its path to the burner deck ports 28. The high velocity of the mixture prevents flashback into the burner even at reduced excess air levels. Distribution has been found to be extremely good along the entire burner length without having large dead areas for negation of dynamic pressure pulses since the directional porting substantially negates such pulses. This homogeneous distribution contributes to the flashback resistant nature of the burner, by keeping the loading on each part of the burner deck at a substantially constant and relatively high level. It may be stated that the longer the length of the distribution tube from entry of the mixture to the beginning of the louvers 40, the better the mixing without increasing the pressure drop too greatly as the mixture exits the ports 38. The use of directional porting 40 allows this longer mixing length in the distibution tube 30, and gives good distribution without a large pressure drop across the ports 38.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A premixed gas burner comprising an elongated substantially hollow first body member defining a gas/air distributor having a periphery defining a curvilinear cross sectional configuration, said distributor having an inlet for receiving a combustible mixture of gas and air and outlet means comprising means forming a plurality of apertures through which said mixture is directed to flow upstream toward said inlet, said outlet means being disposed about a sector of said periphery spaced downstream from said inlet, a second elongated hollow body member defining a burner body, said burner body having a periphery defining a curvilinear cross sectional configuration substantially conforming in shape to that of said distributor but larger than said distributor such that said distributor may be received therein, means for securely positioning said distributor within said burner body in spaced apart relationship with said inlet extending out said burner body, said burner body having a deck comprising a multiplicity of burner ports extending therethrough disposed in an array over a sector of the periphery of said burner body, the sector of the periphery of said distributor containing said outlet means being disposed substantially oppositely to that of the sector of the periphery of said burner containing said burner ports.

2. A premixed gas burner as recited in claim 1, wherein said means forming said apertures are defined between louvers formed in said distributor inclined relative to the interior of said distributor to direct a mixture of gas and air upstream.

3. A premixed gas burner as recited in claim 1, wherein the cross sectional configuration of said distributor and of said burner body is circular and each of said distributor and burner body substantially forms a cylinder.

4. A premixed gas burner as recited in claim 3 wherein said means forming said apertures are defined between louvers formed in said distributor inclined relative to the interior of said distributor to direct a mixture of gas and air upstream.

5. A premixed gas burner as recited in claim 3, wherein said inlet is formed at a first end of said distributor and the end opposite said inlet is closed.

6. A premixed gas burner as recited in claim 5, wherein said means forming said apertures are defined between louvers formed in said distributor inclined relative to the interior of said distributor to direct a mixture of gas and air upstream.

7. A premixed gas burner as recited in claim 5, wherein said burner body receives said distributor through a first end and the end opposite said first end is closed.

8. A premixed gas burner as recited in claim 7, wherein said means forming said apertures are defined between louvers formed in said distributor inclined relative to the interior of said distributor to direct a mixture of gas and air upstream.

9. A premixed gas burner as recited in claim 7, wherein a common closure member closes said distributor mad said burner.

10. A premixed gas burner as recited in claim 9, wherein said means forming said apertures are defined between louvers formed in said distributor inclined relative to the interior of said distributor to direct a mixture of gas and air upstream.

11. A premixed gas burner as recited in claim 3, wherein each of said sectors comprises an arc of a circle.

12. A premixed gas burner as recited in claim 11, wherein said means forming said apertures are defined between louvers formed in said distributor inclined relative to the interior of said distributor to direct a mixture of gas and air upstream.

13. A premixed gas burner as recited in claim 11, wherein each arc is approximately 60° of the periphery of the distributor and the burner body respectively.

14. A premixed gas burner as recited in claim 13, wherein said means forming said apertures are defined between louvers formed in said distributor inclined relative to the interior of said distributor to direct a mixture of gas and air upstream.

15. A premixed gas burner as recited in claim 11, wherein said inlet is formed at a first end of said distributor and the end opposite said inlet is closed.

16. A premixed gas burner as recited in claim 15, wherein said means forming said apertures are defined between louvers formed in said distributor inclined relative to the interior of said distributor to direct a mixture of gas and air upstream.

17. A premixed gas burner as recited in claim 16, wherein said burner body receives said distributor through a first end and the end opposite said first end is closed.

18. A premixed gas burner as recited in claim 13, wherein said inlet is formed at a first end of said distributor and the end opposite said inlet is closed.

19. A premixed gas burner as recited in claim 18, wherein said means forming said apertures are defined between louvers formed in said distributor inclined relative to the interior of said distributor to direct a mixture of gas and air upstream.

20. A premixed gas burner as recited in claim 19, wherein said burner body receives said distributor through a first end and the end opposite said first end is closed.

* * * * *